United States Patent [19]

Fermaglich et al.

[11] Patent Number: 4,873,735

[45] Date of Patent: Oct. 17, 1989

[54] PERCH FOR INFANTS AND HANDICAPPED INDIVIDUALS

[76] Inventors: Daniel R. Fermaglich; Lois F. Fermaglich, both of 9 Van Duyne Rd., Mountain Lakes, N.J. 07046

[21] Appl. No.: 77,371

[22] Filed: Jul. 24, 1987

Related U.S. Application Data

[63] Continuation-in-part of Ser. No. 867,466, May 23, 1986, abandoned, which is a continuation-in-part of Ser. No. 552,603, Nov. 17, 1983, abandoned.

[51] Int. Cl.[4] ..... A47C 20/00

[52] U.S. Cl. ..... 5/431; 5/86; 248/624; 297/296; 272/71

[58] Field of Search ..... 5/431, 435, 101, 104, 5/108, 571, 572, 573; 297/195, 458, 264–268; 272/71, 144; D6/333; D23/52, 53; 248/624 X

[56] References Cited

U.S. PATENT DOCUMENTS

| | | | |
|---|---|---|---|
| 849,975 | 4/1907 | Carlson | 248/624 |
| 1,431,109 | 10/1922 | Fodrea | 248/624 |
| 1,572,273 | 2/1926 | Elton | 5/431 |
| 1,648,055 | 11/1927 | Mesinger | 248/624 |
| 2,281,629 | 5/1942 | Snow | 5/431 |
| 2,508,932 | 5/1950 | Turner . | |
| 2,509,040 | 5/1950 | Kibbe . | |
| 2,680,593 | 6/1954 | McIntyre . | |
| 2,743,104 | 4/1956 | Dodson | 248/624 |
| 2,854,064 | 9/1958 | Judd et al. . | |
| 2,876,459 | 3/1959 | Ackerson | 4/185 |
| 2,876,459 | 3/1959 | Ackerson . | |
| 2,887,151 | 5/1959 | Springer | 5/431 |
| 2,903,262 | 9/1959 | Stukenborg | 248/624 |
| 3,071,410 | 1/1963 | Gaskin | 272/71 |
| 3,115,365 | 12/1963 | Hershberger et al. | 248/624 |
| 3,119,626 | 1/1964 | Strader | 248/624 |
| 3,235,306 | 2/1966 | Chernivsky | 297/296 |
| 3,271,028 | 9/1966 | Albin | 5/431 |
| 3,733,104 | 5/1973 | Carstensen | 5/66 |
| 3,829,079 | 8/1974 | Fox | 5/431 |
| 3,839,755 | 10/1974 | Iannucci | 5/86 |
| 3,839,755 | 10/1974 | Iannucci . | |
| 4,356,577 | 11/1982 | Taylor et al. | 5/81 R |
| 4,359,045 | 11/1982 | Cozzi | 5/431 |
| 4,453,540 | 6/1984 | Frain | 5/431 |
| 4,598,946 | 7/1986 | Cone | 297/264 |
| 4,728,087 | 3/1988 | Wils | 248/624 |
| 4,743,008 | 5/1988 | Fermaglich et al. | 272/69 |

FOREIGN PATENT DOCUMENTS

| | | | |
|---|---|---|---|
| 2335573 | 1/1974 | Fed. Rep. of Germany | 5/431 |
| 2454782 | 11/1980 | France . | |
| 808935 | 2/1959 | United Kingdom . | |
| 1239175 | 7/1971 | United Kingdom | 5/431 |
| 2102283 | 2/1983 | United Kingdom . | |

OTHER PUBLICATIONS

Effectiveness of Positioning Therapy for Gastroesophageal Reflux, Meyers et al., Pediatrics Journal, vol. 69, No. 6, Jun. 1982, p. 768.

*Primary Examiner*—Richard E. Moore
*Assistant Examiner*—Vinh Luong
*Attorney, Agent, or Firm*—Ralph W. Selitto, Jr.

[57] ABSTRACT

A perch for infants or handicapped persons employs a support member which is designed such that an individual can be laid on it in a prone, generally fetal-like position. The support member has an upper end adapted to support the individual's head such that the head can be picked up and moved from side to side, a lower end adapted to support the individual's buttocks and a midsection adapted to support the individual's trunk. Cutouts in the midsection near the upper end of the support member permit the individual's arms to hang freely on opposite sides of the support member. Similarly, cutouts in the midsection near the lower end of the support member permit the individual's legs to hang freely on opposite sides of the support member. A base positions the support member above a support surface such that the individual's legs and arms are freely suspended above the support surface. By interchanging various different bases, the perch can be converted into a rocker, a car seat, a swing or a stroller.

23 Claims, 8 Drawing Sheets

PERCH FOR INFANTS AND HANDICAPPED INDIVIDUALS

CROSS-REFERENCE TO RELATED APPLICATIONS

This is a continuation-in-part application of U.S. application Ser. No. 867,466, filed May 23, 1986 now abandoned which is a continuation-in-part application of U.S. application Ser. No. 552,603, filed Nov. 17, 1983, abandoned.

FIELD OF THE INVENTION

The present invention relates to a perch for infants and handicapped individuals which places them in a prone position and provides head and neck support, permitting them to interact with their environment and, in the case of infants, to relieve the symptoms of colic and gasto-sophageal reflux.

BACKGROUND OF THE INVENTION

Typically, infant seats are of a lounge chair type in which the infant is maintained on its back in a reclined position. Such infant seats are not physiologic. That is, sitting back for an infant who does not have control of its head or its back makes it difficult for the infant to see and interact with its environment.

For many years, some pediatricians have advised parents of infants with colic to lay the infant face down along the parent's forearm, shoulder of knee. In such a position, which is generally fetal-like, pressure exerted on the infant's chest and abdomen tends to quiet it.

Gaskins U.S. Pat. No. 3,071,410 discloses a baby burp seat adapted to support an infant in a prone position which permits the infant to have a better view of its surroundings and which aids the infant in the relief of stomach gases. The Gaskins seat does, however, have its limitations. For instance, because there is no structure for supporting the head of the infant, the Gaskins seat can only be used by an infant whose neck muscles are strong enough to support its head without any other aids. From a practical standpoint, therefore, the Gaskins seat can only be used by infants who are about three months old or older. The lack of a head support also prevents the Gaskins seat from being used like a conventional chair to support an infant on its back in a reclined position.

SUMMARY OF THE INVENTION

The present invention relates to a baby perch for infants or hanidcapped individuals in which an individual is laid in a prone, generally fetal-like position on a specially designed support member. More particularly, the support member, which can be molded monolithically from plastic or fiberglass, has an upper end adapted to support the individual's head such that the head can be picked up and moved from side to side, a lower end adapted to support the individual's buttocks and a midsection adapted to support the individual's trunk. Cutouts in the midsection near the upper end of the support member permit the individual's arms to hand freely on opposite sides of the support member. Similarly, cutouts in the midsection near the lower end of the support member permit the individual's legs to hang freely on opposite sides of the support member.

A base member depending from the support member positions it at a distance above a support surface, such as a floor, the distance being selected such that the individual's legs and arms are suspended above the support surface. The base member maintains the support member at an inclined angle relative to the horizontal. This angle is preferably in a range of from about 30° to about 45°. A strap attached to a pair of wings extending upwardly and outwardly from the midsection of the support member can be used to prevent the individual from falling off of the support member.

Because the individual's head is arranged generally horizontally and at a higher elevation than the rest of the body, the individual can readily interact with its environment, whereby the individual may respond to various stimuli in its environment. In the case of a handicapped infant especially, the parent or therapist may be in direct view of the infant while the infant is being fed or otherwise interacting with its environment. The ability of the infant to directly view the parent or therapist enhances the infant's emotional development. Also, by permitting movement of the individual's head, its head, neck and chest muscles may be strengthened and developed, thereby enhancing the individual's physical development. Because provision is made to support the head, the perch can be used by newborn infants, as well as by older infants. The ability to support an infant or a handicapped individual in a prone position offers the further advantage of reducing the possibility of aspiration of regurgitated material.

The shape of the midsection of the support member is designed so as to maintain the individual in a generally fetal-like position which makes the individual more secure and comfortable. In the case of an infant who has colic, the midsection of the support member applies sufficient pressure to the infant's chest and abdomen to relieve the pain and discomfort caused by the colic, resulting, in many instances, in the termination of the crying which is normally associated with colic.

The shape of the support member also permits the perch to support an individual in a supine position (i.e., on its back in a reclined position). By increasing the angle of inclination of the support member beyond 45°, the perch can also be used like a conventional chair to support the individual in a generally upright (i.e., sitting) position.

By removably mounting the support member on the base member, the base member can be removed and replaced with another type of base, such as a car seat base, a rocker base, swing chains or a stroller chassis. The ability to interchange bases makes the perch convertible.

BRIEF DESCRIPTION OF THE DRAWINGS

For a more complete understanding of the present invention, reference is made to the following detailed description of two exemplary embodiments and various modified versions thereof considered in conjunction with the accompanying drawings, in which.

DESCRIPTION OF THE EXEMPLARY EMBODIMENTS

Figure 1:
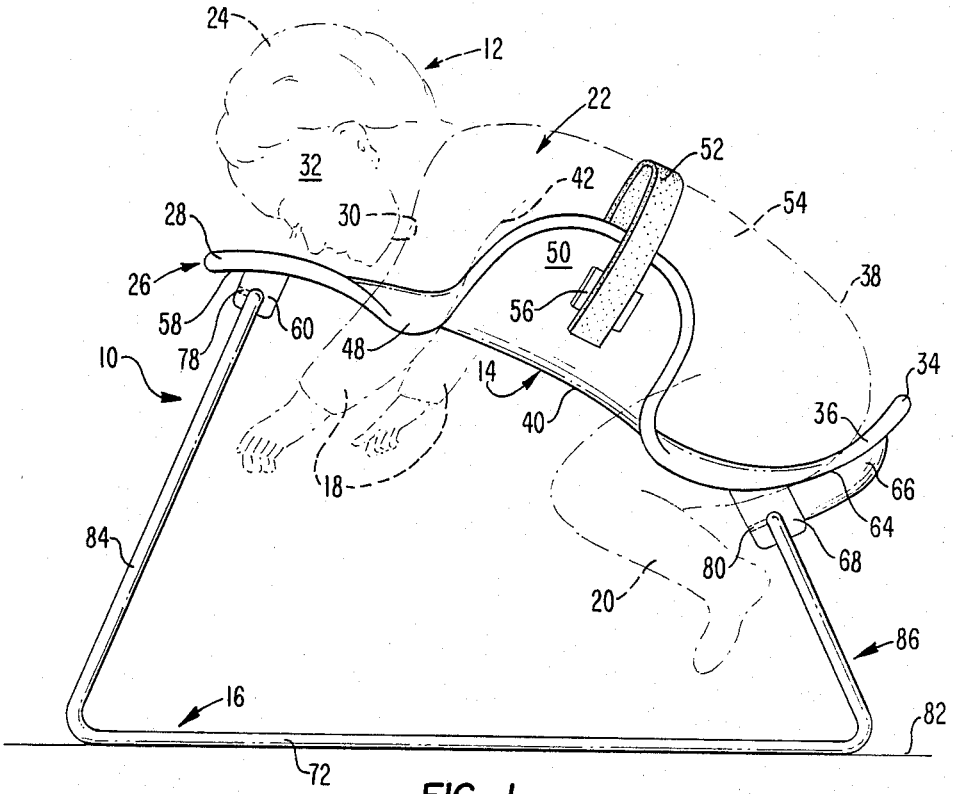
FIG. 1 is a side elevational view of a perch constructed in accordance with one embodiment of the present invention and adapted to support an infant in a prone position (as shown) or in a supine position.
Figure 2:
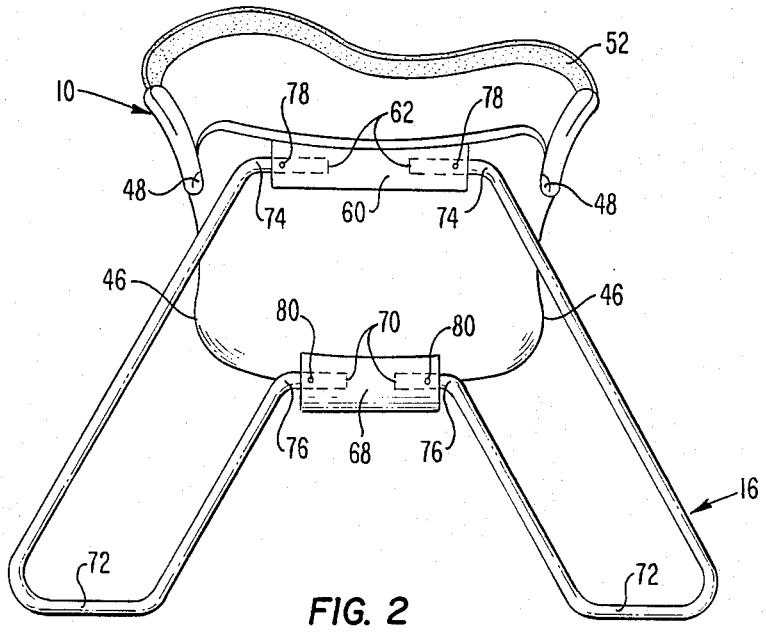
FIG. 2 is a front elevational view of the perch illustrated in FIG. 1.
Figure 3:
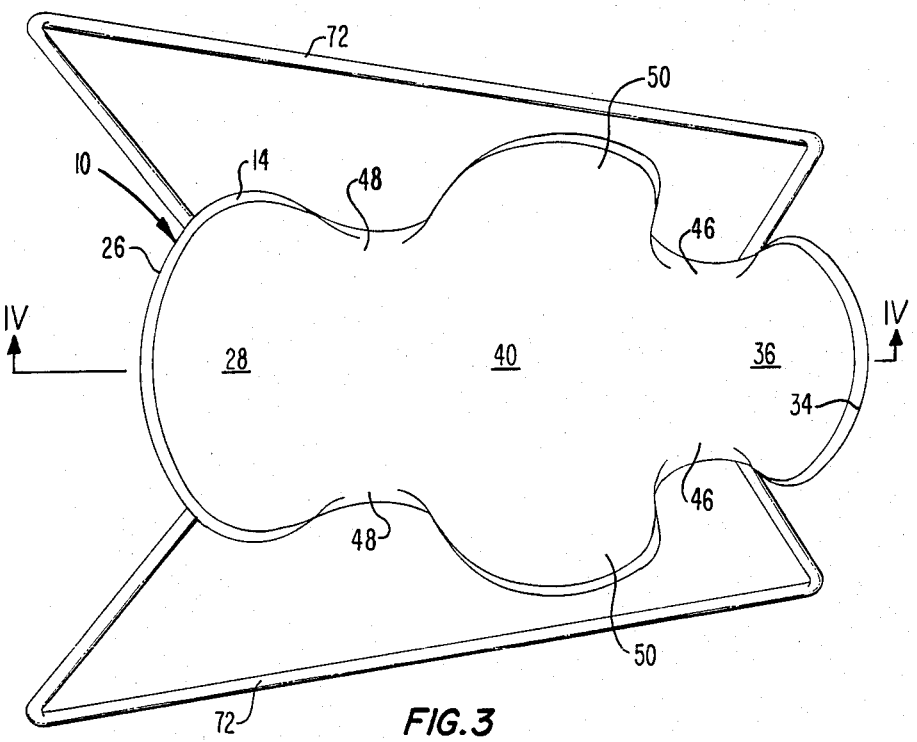
FIG. 3 is a top view of the perch illustrated in FIGS. 1 and 2.
Figure 4:
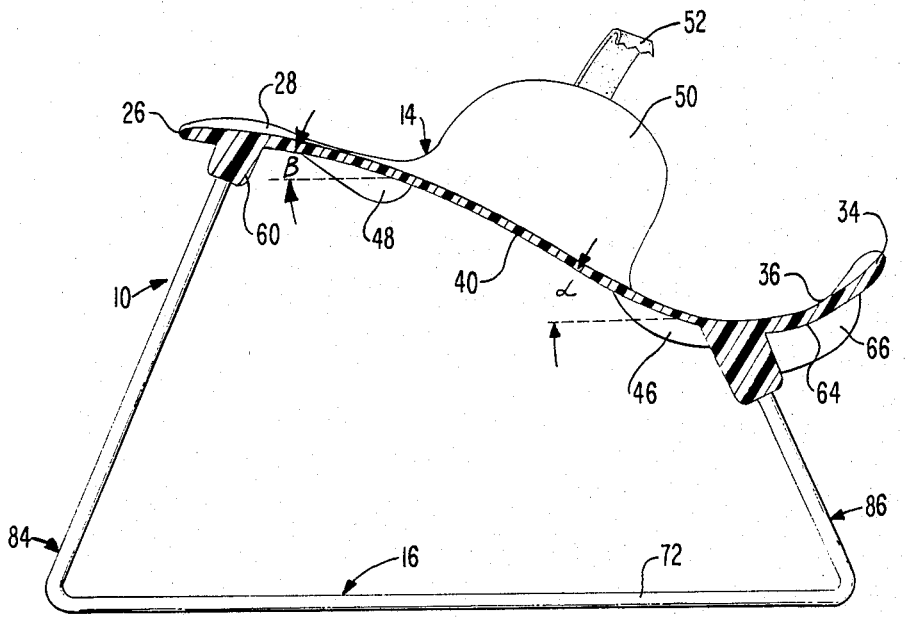
FIG. 4 is a cross-sectional view, taken along the line IV—IV in FIG. 3 and looking in the direction of the arrows, of the perch illustrated in FIG. 3.

While the present invention can be used by infants or handicapped individuals, it is especially suitable for use by infants. Thus, the present invention will be described with particular reference to two exemplary embodiments designed specifically for use by infants.

With reference to FIGS. 1–4, a perch 10 for an infant 12 (shown in phantom in FIG. 1) includes a support member 14 and a base member 16. The support member 14 and the base member 16 cooperate to maintain the infant 12 in a prone (i.e., face down) generally fetal-like position in which the infant's arms 18 and legs 20 are freely suspended below the infant's body 22 and in which the infant's head 24 is arranged at a higher elevation than the rest of the infant's body 22.

The support member 14, which is molded monolithically from plastic or fiberglass, includes an upper end 26 in the form of a relatively flat horizontally arranged ledge 28, which is sized and shaped so as to support the infant's chin 30 if the head 24 is face down or the infant's cheek 32 if the head 24 is turned to either side. A lower end 34 of the support member 14 is in the form of a saddle 36, which is sized and shaped so as to support the infant's buttocks 38. Between its upper end 26 and its lower end 34, the support member 14 includes a midsection 40, which is sized and shaped so as to support the infant's chest 42 and abdomen 44. The midsection 40, which is gently curved such that it has a longitudinal cross-sectional shape which is convex relative to the infant 12, exerts a sufficient pressure on the infant's chest 42 and abdomen 44 to relieve the symptoms (e.g, crying) of colic and promotes the support of the infant 12 in a generally fetal-like position.

The midsection 40 of the support member 14 has a pair of cutouts 46 adjacent the lower end 34 of the support member 14 and a pair of cutouts 48 adjacent the upper end 26 of the support member 14. Each of the cutouts 46 is sized and shaped so as to receive one of the legs 20 of the infant 12 such that the infant's legs 20 straddle the support member 14 on opposite sides thereof. Each of the cutouts 48 is sized and shaped so as to receive one of the arms 18 of the infant 12 such that the infant's arms 18 straddle the support member 14 on opposite sides thereof. The cutouts 46, 48 are flared for the infant's comfort.

A pair of wings 50 is attached to the midsection 40 of the support member 14, the wings 50 extending generally upwardly and outwardly from opposite sides of the midsection 40. A strap 52 is attached to the wings 50. The strap 52 passes around the infant's back 54 such that the infant 12 can be strapped onto the support member 14. The wings 50 cooperate with the strap 52 to restrain the infant 12 and to prevent if from rolling off the support member 14. A Velcro fastener 56 on one of the wings 50 permits the strap 52 to be adjusted.

An undersurface 58 of the upper end 26 of the support member 14 includes a sleeve 60 having a pair of sockets 62 (see FIG. 2) adapted to connect the support member 14 to the base member 16 in a manner to be described hereinafter. An undersurface 64 of the lower end 34 of the support member 14 includes strengthening ribs 66 and a sleeve 68 having a pair of sockets 70 (see FIG. 2) adapted to connect the support member 14 to the base member 16 in a manner to be described hereinafter.

The base member 16 includes a pair of tubular legs 72, each of which is bent into an angular shape. The legs 72 have ends 74, 76 which are removably received in the sockets 62, 70, respectively, of the sleeves 60, 68 provided on the support member 14 (see FIG. 2). Set screws 78, which are threadedly received in holes (not shown) provided in the sleeve 60, releasably engage the ends 74 of the legs 72 when the set screws 78 are tightened. Upon loosening the set screws 78, the ends 74 of the legs 72 can be removed from the sockets 62 of the sleeve 60. Set screws 80, which are threadedly received in holes (not shown) provided in the sleeve 68, releasably engage the ends 76 of the legs 72 when the set screws 80 are tightened. Upon loosening the set screws 80, the ends 76 of the legs 72 can be removed from the sockets 70 of the sleeve 68.

The size and shape of the legs 72 are such that the support member 14 is positioned a distance above a support surface 82, such as a floor (see FIG. 1). This distance is selected such that the infant's arms 18 and legs 20 are suspended above the support surface 82. Also, the legs 72 maintain the midsection 40 of the support member 14 at an angle $\alpha$ inclined relative to the horizontal, while the ledge 28 is maintained at another angle $\beta$ inclined relative to the horizontal such that the angle $\beta$ is not greater than the angle $\alpha$. The angle $\alpha$ is preferably in a range of from about 30° to about 45°, while the angle $\beta$ is preferably in a range of from about 15° to about 30°. The legs 72 extend laterally outwardly from the support member 14 to enhance the stability of the base member 16. The stability of the base member 16 is further enhanced by designing the legs 72 such that the base member 16 has a front end 84 which is wider than a back end 86 (see FIG. 3). Because the legs 72 are detachable, they can be removed from the support member 14 and replaced with other legs of a different size and/or shape to thereby vary or adust the height of the perch 10 or its angle of inclination. Also, once the legs 72 have been detached, the support member 14 can be mounted on other types of bases, whereby the perch 10 can be converted for other uses. Examples of such other uses are described below.

Figure 5:
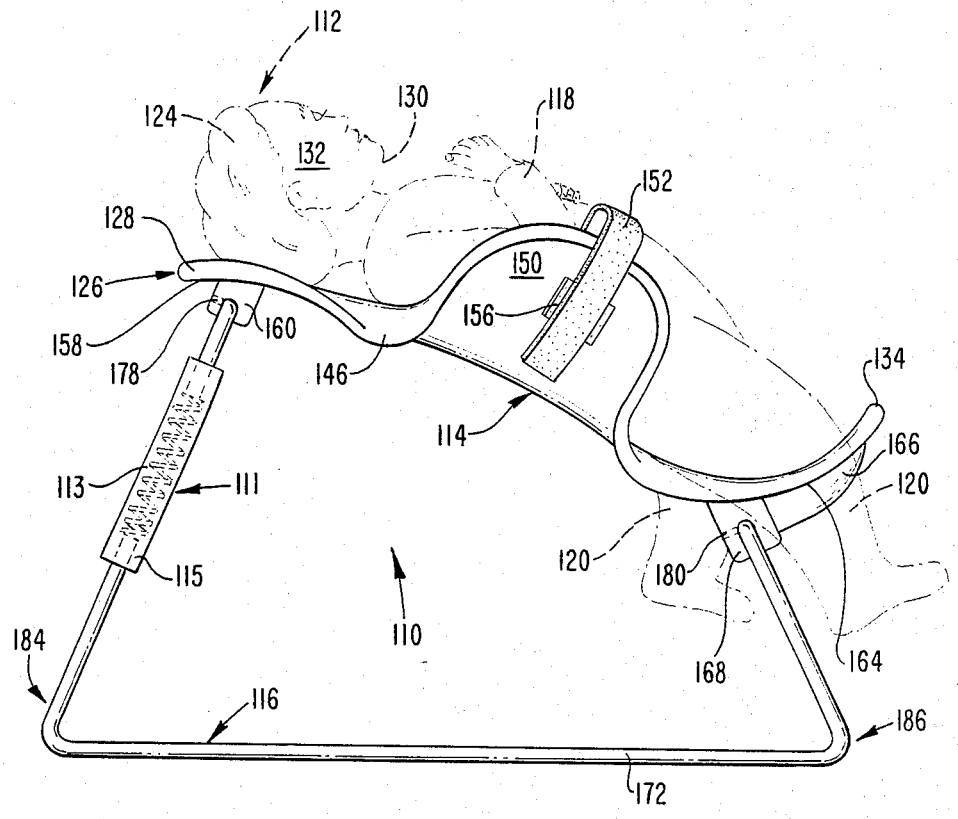
FIG. 5 is a side elevational view of the perch illustrated in FIG. 1, the perch having been converted into a rocker adapted to support an infant in a prone position or in a supine position (as shown)
Figure 6:
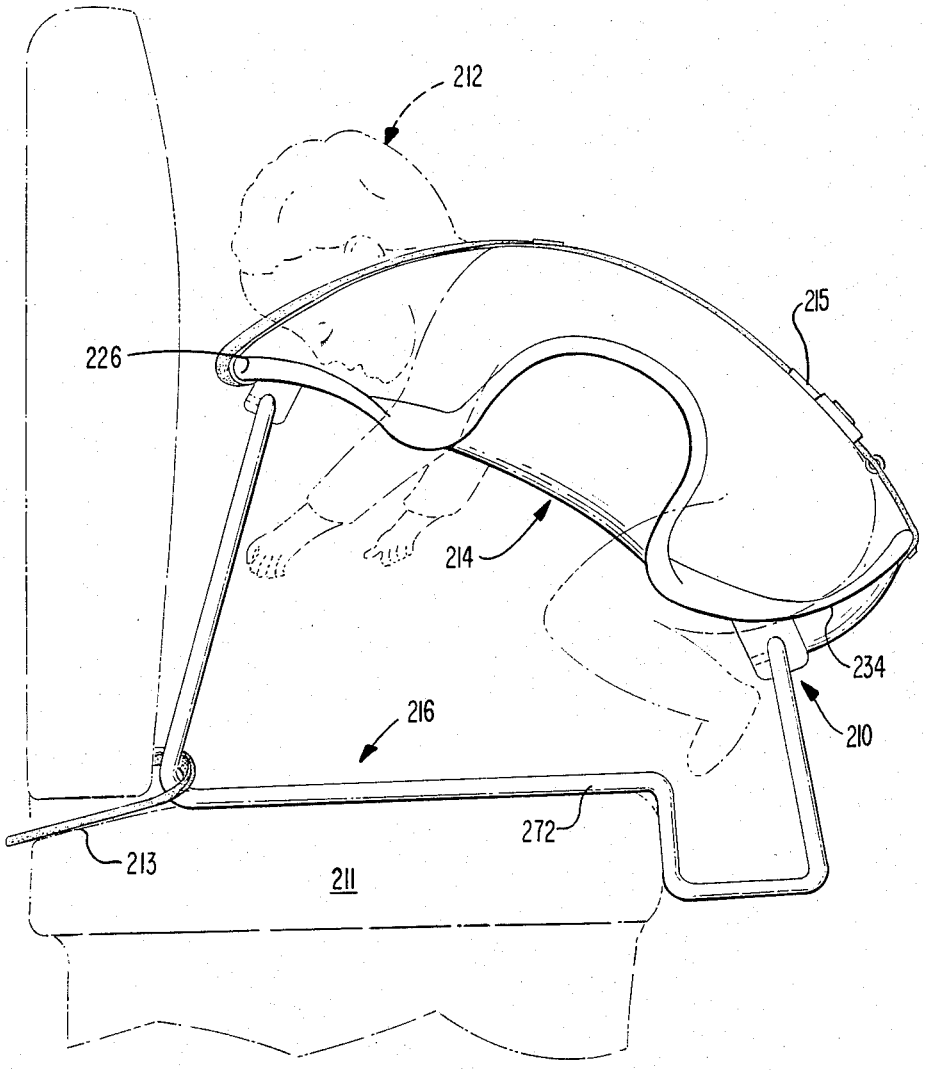
FIG. 6 is a side elevational view of the perch illustrated in FIG. 1, the perch having been converted into a car seat adapted to support an infant in a prone position (as shown) or in a supine position.

Converted versions of the embodiment illustrated in FIGS. 1–4 are illustrated in FIGS. 5 and 6. Various elements illustrated in FIGS. 5 and 6 which correspond to elements described above with respect to the embodiment of FIGS. 1–4 are designated by corresponding reference numerals increased by one hundred and two hundred, respectively. Unless otherwise stated, the converted versions illustrated in FIGS. 5 and 6 operate in the same manner as the embodiment of FIGS. 1–4.

With reference to FIG. 5, a perch 110 includes a support member 114 and a base member 116. An infant 112 is maintained on the support member 114 in a supine position by a strap 152. The support member 114 and the base member 116 are essentially identical to the support member 14 and the base member 16, respectively, of the embodiment illustrated in FIGS. 1–4, except that legs 172 of the base member 114 are provided with spring assemblies 111 designed to permit the reciprocating movemet of a front end 184 of the base member 114, whereby the perch 110 can function as a rocker. More particularly, each of the spring assemblies 111 includes a coil spring 113 which can be compressed by the application of a downwardly acting force, whereby someone attending the infant 112 can push on an upper end 126 of the support member 114 to compress the coil spring 113 and thereby cause the downward movement of the upper end 126 of the support member 114. When such a force is removd from the upper end 126 of the support member 114, the upper end 126 of the support member 114 is automatically moved upwardly by the coil springs 113 to thereby return the upper end 126 of the support member 114 to its normal position. Each of the coil springs 113 is surrounded by a flexible sleeve 115, which inhibits the infant 112 from getting his or her fingers pinched or otherwise injured by the coil springs 113.

Referring now to FIG. 6, a perch 210 includes a support member 214 and a base member 216. An infant 212 is maintained on the support member 214 in a prone position. Except for two modifications, one involving the support member 214 and the other involving the base member 216, the support member 214 and the base member 216 are essentially identical to the support member 14 and the base member 16, respectively, of the embodiment illustrated in FIGS. 1–4. The modification of the base member 216 involves shaping legs 272 such that they will conform generally to the shape of an automoblie seat 211 (shown in phantom), whereby the perch 210 can be attached to the seat 211 by, for instance, a conventional seat belt 213. The modification of the support member 214 involves the provision of a harness 215 which extends from an upper end 226 of the support member 214 to a lower end 234 of the support member 214 and which replaces the strap 52 employed by the embodiment of FIGS. 1–4. The harness 215 functions as an additional safety feature when the perch 210 is used as a car seat.

Figure 7:
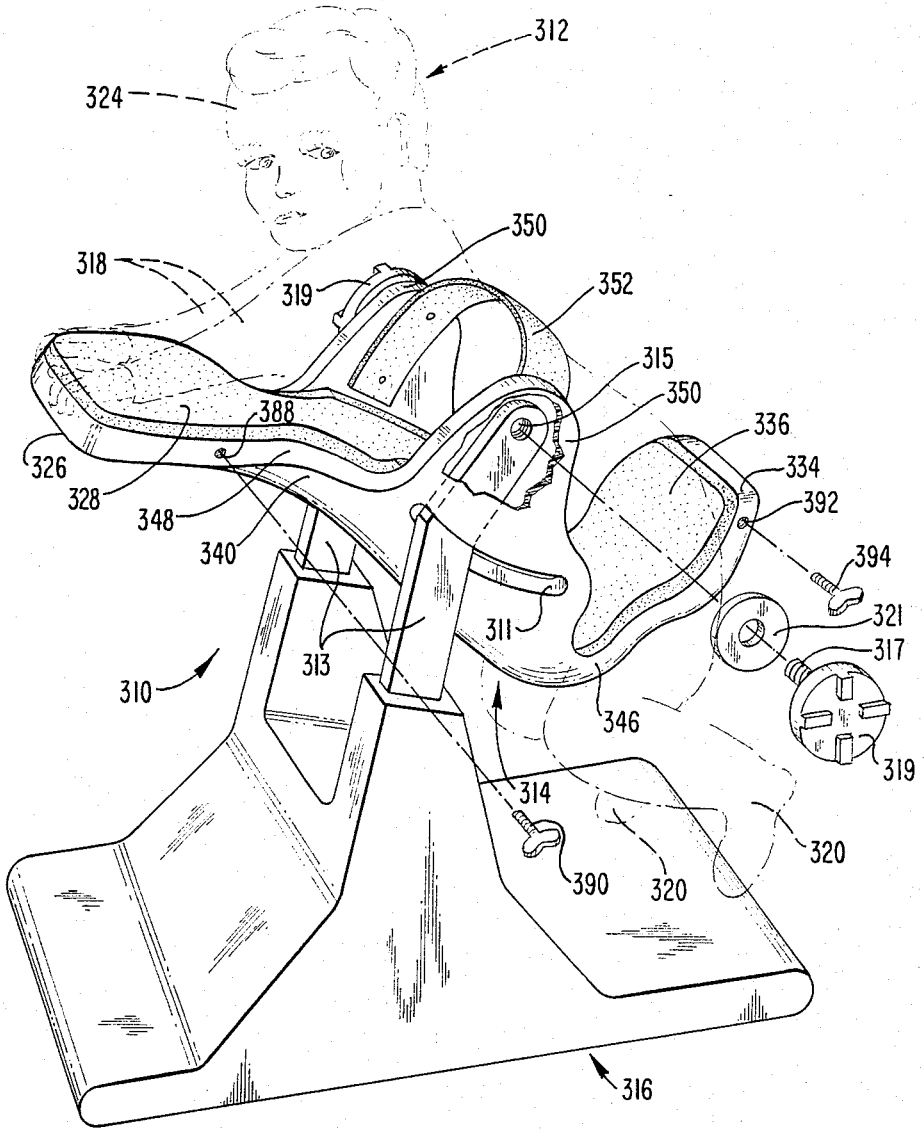
FIG. 7 is a perspective view of a perch constructed in accordance with another embodiment of the present invention and adapted to support an infant in a prone position (as shown) or in a supine position, certain portions of the perch being broken away and other portions being exploded away to facilitate consideration and discussion.
Figure 8:
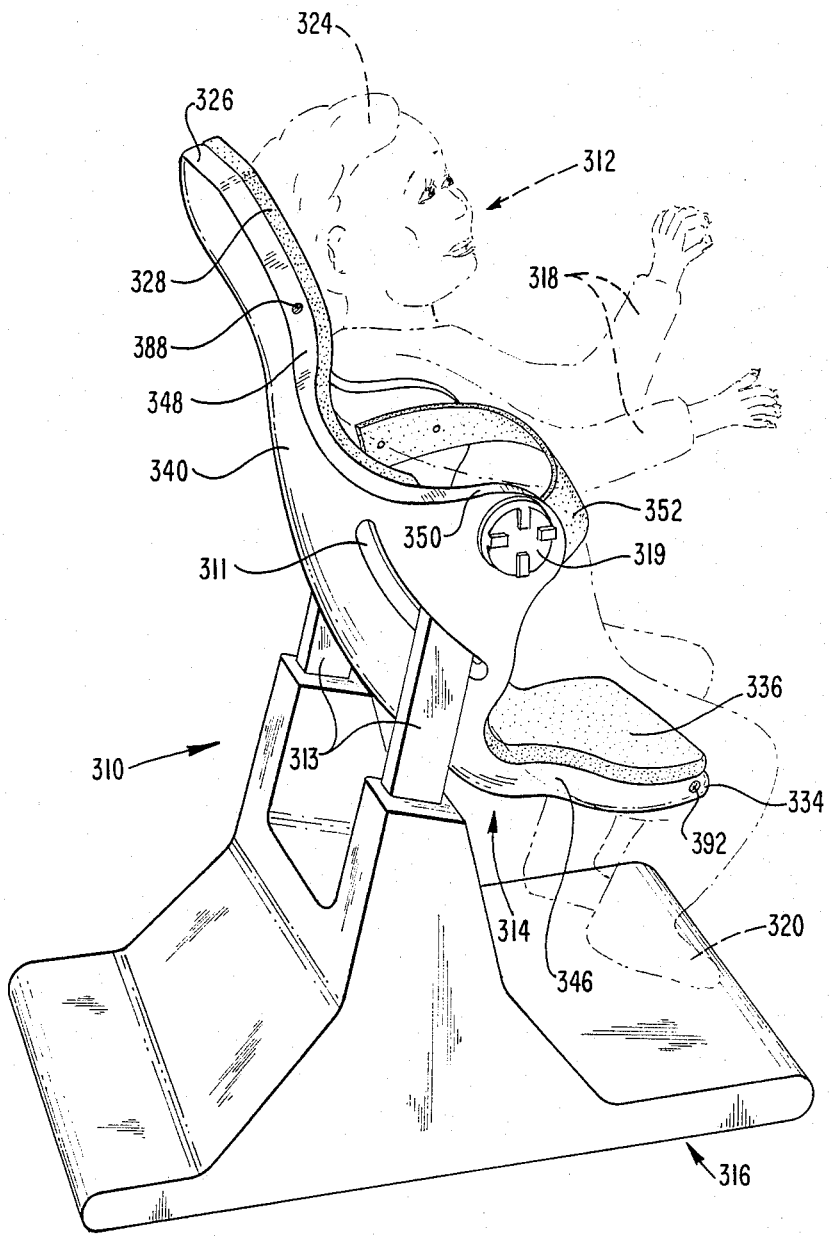
FIG. 8 is a perspective view of the perch shown in FIG. 7, the perch having been adjusted so that it can support an infant in a sitting position.

Another exemplary embodiment of the present invention is illustrated in FIGS. 7 and 8. Various elements illustrated in FIGS. 7 and 8 which correspond to elements described above with respect to the embodiment of FIGS. 1–4 are designated by corresponding reference numerals increased by three hundred. Unless otherwise stated, the embodiment of FIGS. 7 and 8 operates in the same nanner as the embodiment of FIGS. 1–4.

With reference now to FIGS. 7 and 8, a perch 310 for an infant 312 (shown in phantom) includes a support member 314 and a base member 316. Although the infant 312 is shown in a generally prone, fetal-like position in FIG. 7, it could also be maintained in a supine position (i.e., on its back in a reclined position).

The support member 314 has an upper end 326 in the form of a relatively flat ledge 328, a midsection 340, and a lower end 334 in the form of a saddle 336 extending upwardly and outwardly from the midsection 340. A pair of wings 350 is attached to the midsection 340 of the support member 314, the wings 350 extending generally upwardy and outwardly from opposite sides of the midsection 340. Each of the wings 350 is provided with a slot 311 for a purpose to be described hereinafter.

The base member 316 has a pair of uprights 313. Each of the uprights 313 extends into a corresponding one of the slots 311 and includes an internally threaded bore 315, each of which threadedly receives an externally threaded bolt 317 provided on an adjusting knob 319. A plastic washer 321 is received on the bolt 317 between the adjusting knob 319 and an associated one of the wings 350. By turning the adjusting knobs 319 such that the bolts 317 are screwed further into the bores 315 in the uprights 313, each washer 321 is sandwiched between its corresponding adjusting knob 319 and wing 350 to thereby lock the support member 314 in a preselected position (i.e., at a preselected angle of inclination). In order to change the angle of inclination of the support member 314 relative to the base member 316, the adjusting knobs 319 are rotated in an opposite direction so that the washers 321 are no longer sandwiched between their corresponding adjusting knobs 319 and wings 350. After adjusting the angle of inclination of the support member 314, the adjusting knobs 319 would be retightened to lock the support member 314 in its adjusted position, like the one shown in FIG. 8 in which the infant 312 (shown in phantom) is maintained in a substantially conventional sitting position.

Internally threaded holes 388 (only one of which is visible in FIGS. 7 and 8) are provided in opposite sides of the upper end 326 of the support member 314. Each of the holes 388 threadedly receives an externally threaded wing bolt 390. Internally threaded holes 392 (only one of which is visible in FIGS. 7 and 8) are provided in opposite sides of the lower end 334 of the support member 314. Each of the holes 392 threadedly receives an externally threaded wing bolt 394. The purpose of the wing bolts 390, 394 will be described hereinafter, it being noted that the wing bolts 390, 394 would not normally be employed by the embodiment of FIGS. 7 and 8.

Figure 9:
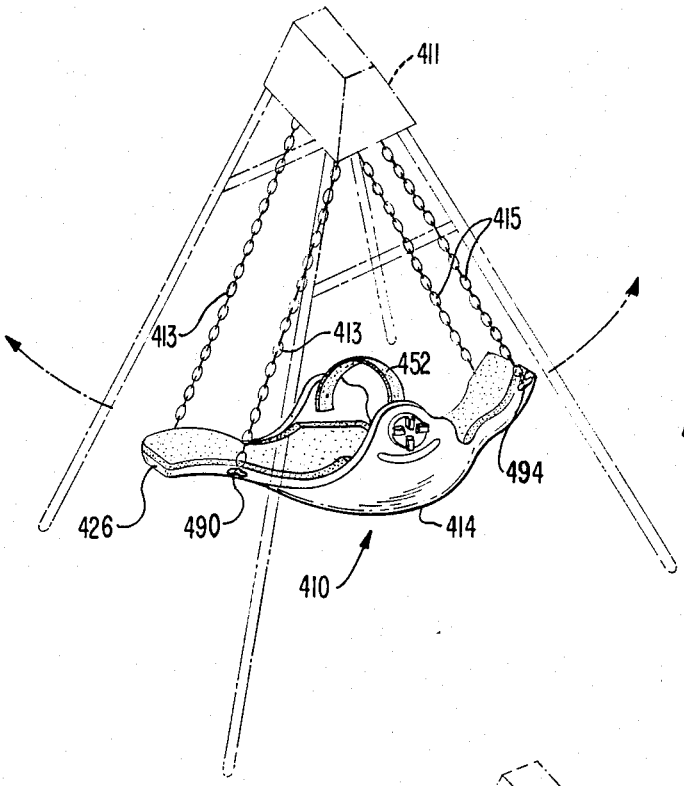
FIG. 9 is a perspective view of the perch illustrated in FIGS. 7 and 8, the perch having been converted into a swing adapted to support an infant in a prone position or in a supine position.
Figure 10:
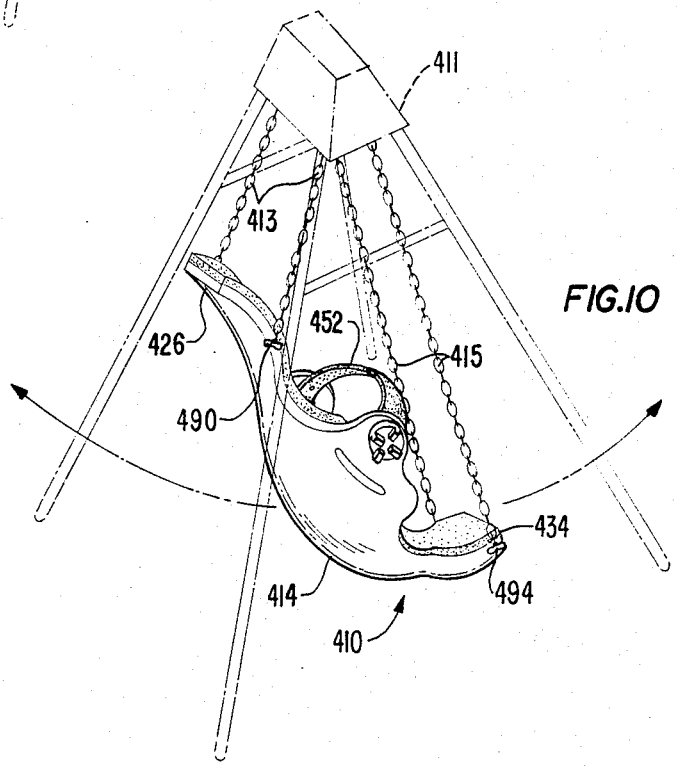
FIG. 10 is a perspective view of the perch illustrated in FIGS. 7 and 8, the perch having been converted into a swing adapted to support an infant in a sitting position.

A converted version of the embodiment illustrated in FIGS. 7 and 8 is illustrated in FIGS. 9 and 10. Various elements illustrated in FIGS. 9 and 10 which correspond to elements described above with respect to the embodiment of FIGS. 7 and 8 are designated by corresponding reference numerals increased by one hundred. Unless otherwise stated, the converted version illustrated in FIGS. 9 and 10 operates in the same manner as the embodiment of FIGS. 7 and 8.

With reference to FIGS. 9 and 10, a perch 410 includes a support member 414 which is suspended from a swing 411 (shown in phantom) by chains 413, 415.

More particularly, the chains 413 are releasably attached to an upper end 426 of the support member 414 by wing bolts 490, while the chains 415 are releaseably attached to a lower end 434 of the support member 414 by wing bolts 494. By varying the length of the chains 413, 145, the orientation of the support member 414 can be adjusted such that it will support an infant in a prone or supine position (see FIG. 9) or in a sitting position (see FIG. 10).

Figure 11:
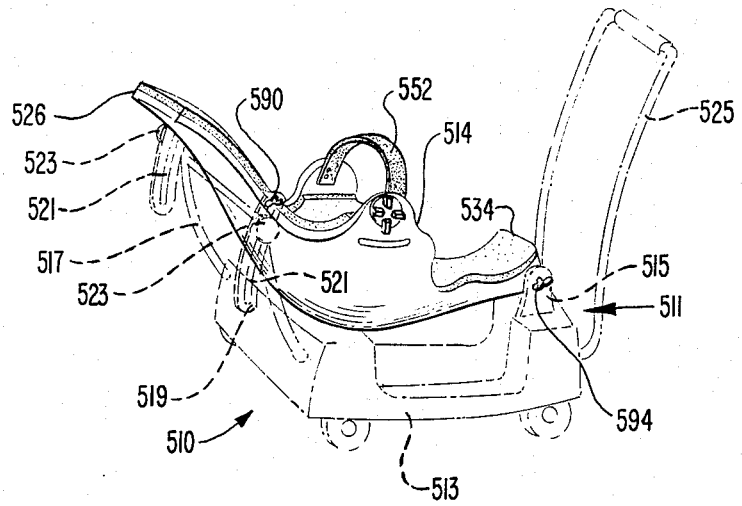
FIG. 11 is a perspective view of the perch illustrated in FIGS. 7 and 8, the perch having been converted into a stroller adapted to support an infant in a prone position or in a supine position.
Figure 12:
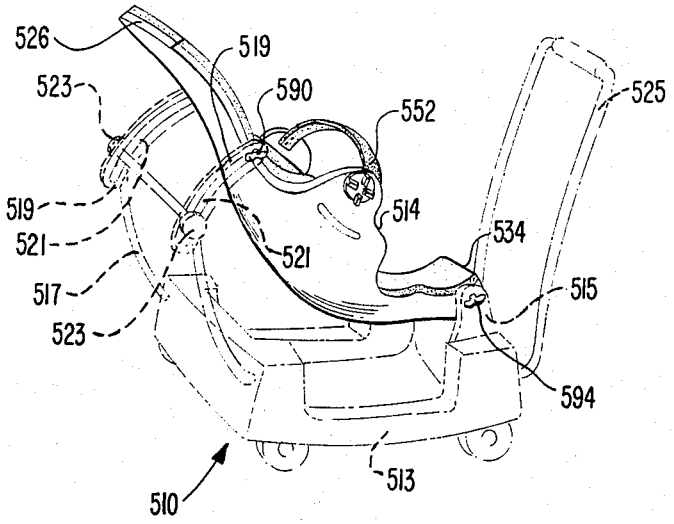
FIG. 12 is a perspective view of the perch illustrated in FIGS. 7 and 8, the perch having been converted into a stroller adapted to support an infant in a sitting position.

Another converted version of the embodiment illustrated in FIGS. 7 and 8 is illustrated in FIGS. 11 and 12. Various elemenets illustrated in FIGS. 11 and 12 which correspond to elements described above with respect to the embodiment of FIGS. 7 and 8 are designated by corresponding reference numerals increased by two hundred. Unless otherwise stated, the converted version illustrated in FIGS. 11 and 12 operates in the same manner as the embodiment of FIGS. 7 and 8.

With reference to FIGS. 11 and 12, a perch 510 includes a support member 514 which is adjustably attached to a stroller 511 (shown in phantom). More particularly, the stroller 511 includes a chassis 513 having stationary brackets 515 (only one of which is visible in FIGS. 11 and 12). Wing bolts 594 (only one of which is visible in FIGS. 11 and 12) releasably and pivotally attach a lower end 534 of the support member 514 to the brackets 515. A yoke 517 extends upwardly from the chassis 513. Slotted brackets 519 are releaseably and pivotally attached by wing bolts 590 (only one of which is visible in FIGS. 11 and 12) to an upper end 526 of the support member 514. Each of the brackets 519 is provided with a curved slot 521 through which a threaded shaft (not shown) of an adjusting knob 523 passes, the shaft being threadedly received in a threaded opening (not shown) in the yoke 517. When the adjusting knobs 523 are not tightened, the position of the brackets 519 can be adjusted relative to the yoke 517. By tightening the adjusting knobs 523, the brackets 519 can be locked in a desired position relative to the yoke 517. Thus, the orientation of the support member 514 can be varied so as to support an infant in a prone or supine position (see FIG. 11) or in a sitting position (see FIG. 12). A handle 525 extends upwardly from the chassis 513 such thant an infant lying in a prone position faces in the general direction of travel of the stroller 511 (i.e., in a direction facing away from the person pushing the stroller 511).

It will be understood that the embodiments described herein are merely exemplary and that a person skilled in the art may make many variations and modifications without departing from the spirit and scope of the invention. For instance, the support members 14, 314 could be manufactured in sections, rather than monolithically, in which case the various sections would be removably but rigidly attached to each other. Also, the embodiment of FIGS. 1–4 could be converted into a swing or a stroller, while the embodiment of FIGS. 7 and 8 could be converted into a rocker or a car seat. All such variations and modifications are intended to be included within the scope of the invention as defined in the appended claims.

We claim:

1. A perch for an infant or a handicapped person, comprising supporting means for supporting an individual in a prone, generally fetal-like position in which all of the individual's limbs are freely suspended below the individual's body and in which the individual's head is arranged at a higher elevation than the rest of the individual's body, said supporting means including a support member, having a midsection which is long enough and wide enough to support the individual's chest and abdomen and which is arranged at a first angle inclined relative to the horizontal, an upper end in the form of a ledge which extends outwardly from said midsection far enough to support the individual's head and which is arranged at a second angle inclined relative to the horizontal such that said second angle is less than said first angle, a lower end in the form of a saddle which extends upwardly and outwardly from said midsection far enough to self-support and cradle the individual's buttocks, a first pair of cutouts provided in said midsection of said support member adjacent said lower end thereof, each cutout of said first pair of cutouts being wide enough to receive one leg of the individual such that the individual's legs straddle said support member on opposite sides thereof, and a second pair of cutouts provided in said midsection of said support member adjacent said upper end thereof, each cutout of said second pair of cutouts being wide enough to receive one arm of the individual such that the individual's arms straddle said support member on opposite sides thereof, and a base member attached to said support member such that said support member is positioned a distance above a support surface, said distance being selected such that the individual's limbs are suspended above the support surface.

2. A perch according to claim 1, wherein said ledge is relatively flat, whereby the individual's head is free to move from side to side so that the individual may interact with its environment.

3. A perch according to claim 2, wherein said midsection is gently curved such that it has a longitudinal cross-sectional shape which is convex relative to the individual to thereby promote the support of the individual in a generally fetal-like position.

4. A perch according to claim 3, wherein said first angle is greater than 30 degrees but less than about 45 degrees and said second angle is greater than about 15 degrees but less than 30 degrees.

5. A perch according to claim 3, wherein said midsection includes restraining means for restraining the individual from rolling off of said support member.

6. A perch according to claim 5, wherein said restraining means includes a pair of wings extending generally upwardly and outwardly from opposite sides of said midsection.

7. A perch according to claim 6, wherein said restraining means further includes a strap attached to said wings and passing around the individual's back such that the individual can be strapped onto said support member.

8. A perch according to claim 7, wherein said support member is made from monolithically molded plastic.

9. A perch according to claim 4, wherein said midsection exerts sufficient pressure on the abdomen and chest of the individual to relieve the symptoms of colic.

10. A perch according to claim 1, further comprising adjusting means for adjusting the position of said support member relative to said base member such that said first angle can be varied.

11. A perch according to claim 10, wherein said support member can be adjusted relative to said base member to such an extent that said midsection can be arranged substantially upright to thereby support the individual in a sitting position.

12. A perch according to claim 1, wherein said support member is sized and shaped so as to support the individual in a supine position, as well as in a prone position.

13. A perch according to claim 1, wherein said support member is removably attached to said base member and wherein said support member includes attaching means for removably and interchangeably attaching a car seat base, a rocker base, swing chains or a stroller chassis to said support member when said base member is detached from said support member.

14. A perch according to claim 1, wherein said base member includes urging means for resiliently urging said upper end of said support member from a retracted position to an extended position, whereby said upper end of said support member can undergo reciprocating movement which permits said perch to function as a rocker.

15. A perch according to claim 14, wherein said urging means includes at least one spring.

16. A perch according to claim 1, wherein said base member is sized and shaped so as to fit securely on a seat of a vehicle, whereby said perch functions as a car seat.

17. A perch according to claim 1, wherein said base member includes suspending means for suspending said support member such that said support member can undergo swinging movement, whereby said perch functions as a swing.

18. A perch according to claim 1, wherein said base member is a movable chassis, whereby said perch functions as a stroller.

19. A perch for newborn infants and older infants, comprising a support member having a gently curved midsection which is long enough and wide enough to support an infant's chest and abdomen such that sufficient pressure is exerted thereon to relieve the symptoms of colic and which is arranged at a first angle inclined relative to the horizontal, an upper end in the form of a relatively flat ledge which extends outwardly from said midsection far enough to support the infant's head such that it is free to move from side to side, whereby the infant may interact with its environment, and which is arranged at a second angle inclined relative to the horizontal such that said second angle is less than said first angle, a lower end in the form of a saddle which extends upwardly and outwardly from said midsection far enough to self-support and cradle the infant's buttocks, a first pair of cutouts provided in said midsection of said support member adjacent said lower end thereof, each cutout of said first pair of cutouts being wide enough to receive one leg of the infant such that the infant's legs straddle said support member on opposite sides thereof, and a second pair of cutouts provided in said midsection of said support member adjacent said upper end thereof, each cutout of said second pair of cutouts being wide enough to receive an arm of the infant such that the infant's arms straddle said support member on opposite sides thereof; a base member attached to said support member such that said support member is positioned above a support surface a distance selected to permit the infant's legs and arms to be suspended above the support surface, whereby the infant may be laid on said support member in a prone, generally fetal-like position in which all of the infant's limbs are freely suspended below the infant's body and in which the infant's head is arranged at a higher elevation than the rest of the infant's body; restraining means for restraining the infant from rolling off of said support member, said restraining means including a pair of wings, one wing extending generally upwardly and outwardly from one side of said midsection of said support member and another wing extending generally upwardy and outwardly from an opposite side of said midsection of said support member, and a strap attached to said wings and passing around the infant's back such that the infant can be strapped onto said support member; and adjusting means for adjusting the position of said support member relative to said base member such that said first and second angles can be varied.

20. A perch according to claim 19, wherein said support member is made from monolithically molded plastic.

21. A perch according to claim 19, wherein said support member can be adjusted relative to said base member to such an extent that said midsection can be arranged substantially upright to thereby support the infant in a sitting position.

22. A perch according to claim 19, wherein said support member is sized and shaped so as to support the infant in a supine position, as well as in a prone position.

23. A rocker for an infant or a handicapped person, comprising supporting means for supporting an individual in a prone, generally fetal-like position in which all of the individual's limbs are freely suspended below the individual's body and in which the individual's head is arranged at a higher elevation than the rest of the individual's body, said supporting means including a support member having a midsection which is long enough and wide enough to support the individual's chest and abdomen and which is arranged at a first angle inclined relative to the horizontal, an upper end in the form of a ledge which extends outwardly from said midsection far enough to support the individual's head and which is arranged at a second angle inclined relative to the horizontal such that said second angle is less than said first angle, a lower end in the form of a saddle which extends upwardly and outwardly from said midsection far enough to self-support and cradle the individual's buttocks, a first pair of cutouts provided in said midsection of said support member adjacent said lower end thereof, each cutout of said first pair of cutouts being wide enough to receive one leg of the individual such that the individual's legs straddle said support member on opposite sides thereof, and a second pair of cutouts provided in said midsection of said support member adjacent said upper end thereof, each cutout of said second pair of cutouts being wide enough to receive one arm of the individual such that the individual's arms straddle said support member on opposite sides thereof, and a base member attached to said support member such that said support member is positioned a distance above a support surface, said distance being selected such that the individual's limbs are suspended above the support surface, said base member including urging means for resiliently urging said upper end of said support member from a retracted position to an extended position, whereby said upper end of said support member can undergo reciprocating movement.

* * * * *